US011580942B2

(12) United States Patent
Xu et al.

(10) Patent No.: US 11,580,942 B2
(45) Date of Patent: Feb. 14, 2023

(54) SYSTEMS, METHODS, SMART MUSICAL INSTRUMENTS, COMPUTER READABLE MEDIA FOR MUSIC SCORE MATCHING

(71) Applicant: SUNLAND INFORMATION TECHNOLOGY CO., LTD., Shanghai (CN)

(72) Inventors: Nan Xu, Shanghai (CN); Bin Yan, Shanghai (CN); Xiaolu Liu, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 234 days.

(21) Appl. No.: 16/920,732

(22) Filed: Jul. 5, 2020

(65) Prior Publication Data

US 2020/0335073 A1 Oct. 22, 2020

Related U.S. Application Data

(63) Continuation of application No. PCT/CN2019/087803, filed on May 21, 2019.

(30) Foreign Application Priority Data

May 28, 2018 (CN) ..... 201810521525.8

(51) Int. Cl.
*G10H 1/00* (2006.01)

(52) U.S. Cl.
CPC ..... *G10H 1/0008* (2013.01); *G10H 2210/091* (2013.01); *G10H 2220/015* (2013.01); *G10H 2250/215* (2013.01)

(58) Field of Classification Search
CPC ..... G10H 2210/091; G10H 2210/066; G10H 2220/015; G10H 2240/131;
(Continued)

(56) References Cited

U.S. PATENT DOCUMENTS

2007/0266843 A1 11/2007 Schneider
2015/0096432 A1 4/2015 Hiratsuka

FOREIGN PATENT DOCUMENTS

CN 101763349 A 6/2010
CN 102142247 A 8/2011
(Continued)

OTHER PUBLICATIONS

International Search Report in PCT/CN2019/087803 dated Aug. 20, 2019, 5 pages.
(Continued)

*Primary Examiner* — Marlon T Fletcher
(74) *Attorney, Agent, or Firm* — Metis IP LLC

(57) ABSTRACT

The present disclosure relates to a system and method for matching performance with score. The method may include acquiring performance information in a preset time period, wherein the performance information is related to a musical device. The method may also include analyzing the performance information and obtaining a played music score in the preset time period, wherein the played music score contains the performance information. The method may further include comparing the played music score with one or more standard music scores. The method may still further include identifying a standard music score from the one or more standard music score based on the comparison of the played music score with the one or more standard music scores, wherein a matching degree between the played music score and the identified standard music score reaches a preset value.

20 Claims, 9 Drawing Sheets

(58) Field of Classification Search
CPC ..... G10H 2240/141; G10H 2210/031; G10H 1/0033; G10H 1/00
See application file for complete search history.

(56) References Cited

FOREIGN PATENT DOCUMENTS

| | | | | | |
|---|---|---|---|---|---|
| CN | 103645875 | A | | 3/2014 | |
| CN | 103871295 | A | | 6/2014 | |
| CN | 105679296 | A | | 6/2016 | |
| CN | 106485984 | A | | 3/2017 | |
| CN | 108038146 | A | | 5/2018 | |
| CN | 108074438 | A | | 5/2018 | |
| CN | 108074554 | A | * | 5/2018 | ..... G06F 16/60 |
| CN | 109065008 | A | * | 12/2018 | ..... G10H 1/0008 |
| EP | 1343138 | A2 | | 9/2003 | |
| JP | H0527670 | A | * | 7/1991 | |
| JP | 2004264392 | A | * | 9/2004 | ..... G10H 1/0008 |
| KR | 20110106532 | A | * | 3/2010 | |
| KR | 101841033 | B1 | * | 9/2016 | |
| KR | 20180072182 | A | * | 12/2016 | |
| KR | 102077642 | B1 | * | 3/2018 | |
| KR | 20220069244 | A | * | 11/2020 | |
| WO | WO-2010142297 | A2 | * | 12/2010 | ..... G09B 15/00 |
| WO | WO-2014189084 | A1 | * | 11/2014 | ..... G06K 9/00442 |
| WO | WO-2014189137 | A1 | * | 11/2014 | ..... G09B 15/00 |
| WO | WO-2017043228 | A1 | * | 3/2017 | ..... G09B 15/023 |
| WO | 2019228230 | A1 | | 12/2019 | |

OTHER PUBLICATIONS

Written Opinion in PCT/CN2019/087803 dated Aug. 20, 2019, 6 pages.
First Office Action in Chinese Application No. 201810521525.8 dated May 12, 2020, 21 pages.

* cited by examiner

SYSTEMS, METHODS, SMART MUSICAL INSTRUMENTS, COMPUTER READABLE MEDIA FOR MUSIC SCORE MATCHING

CROSS REFERENCE TO RELATED APPLICATIONS

This application is a continuation of International Application No. PCT/CN2019/087803, filed on May 21, 2019, which claims priority to Chinese Application No. 201810521525.8 filed on May 28, 2018, the entire disclosure of which is incorporated by reference.

TECHNICAL FIELD

The present disclosure relates to music scores, and more particularly, relates to systems, methods, smart musical instruments, and computer readable media for music score matching.

BACKGROUND

Existing music score matching systems and methods recognize scale-steps in a piece of music using a voice recognition technology, and need to be equipped with a sound acquisition module and voice recognition programs, which are likely to be greatly influenced by environmental factors. Thus, it is desirable to develop systems and methods for music score matching more accurately and efficiently.

SUMMARY

According to a first aspect of the present disclosure, a music score matching method is provided, which may include at least one of the following operations. The method may include acquiring performance information in a preset time period, wherein the performance information is related to a musical device; analyzing the performance information and obtaining a played music score in the preset time period, wherein the played music score contains the performance information; comparing the played music score with one or more standard music scores; and identifying a standard music score from the one or more standard music score based on the comparison of the played music score with the one or more standard music scores, wherein a matching degree between the played music score and the identified standard music score reaches a preset value.

In some embodiments, the method may further include displaying a music score segment and subsequent music score of the identified standard music score corresponding to the played music score in real time, and displaying a prompt for a performance progress on the music score segment in real time.

In some embodiments, the method may further include turning from a current page into a next page of the standard music score automatically when the performance progress reaches an end of the current page of the standard music score.

In some embodiments, the performance information may be non-audio information.

In some embodiments, the performance information may include at least one type of playing sequences, playing durations, playing forces, or playing speeds of keys or strings when the user plays the musical device.

In some embodiments, the played music score includes at least one of a scale-step, a scale-step sequence, a scale-step duration, a scale-step playing force, or a scale-step playing speed associated with the played musical device.

In some embodiments, the musical device is an electronic musical device or a non-electronic musical device.

In some embodiments, the identifying a standard music score from the one or more standard music score based on the comparison comprises placing a standard music score in a two-dimensional coordinate system, wherein a y-axis of the two-dimensional coordinate system represents time and an x-axis of the two-dimensional coordinate system represents time represents scale-step; placing the played music score acquired in the preset time period in the two-dimensional coordinate system; determining the music score matching degree between the played music score and the standard music score by comparing the played music score with the standard music score in the two-dimensional coordinate system; determining whether the music score matching degree reaches the preset value; in response to the determination that the music score matching degree reaches the preset value, determining the matching degree between the played music score and the standard music score to be successful, and identifying the standard music score; and in response to the determination that the music score matching degree reaches the preset value, determining the matching between the played music score and the standard music score to be unsuccessful, and obtaining and comparing another standard music score with the played music score.

In some embodiments, the determining the music score matching degree between the played music score and the standard music score by comparing the played music score with the standard music score in the two-dimensional coordinate system comprises performing a time scale transformation on the y-axis of the two-dimensional coordinate system, wherein the transformation process includes obtaining a soft index value of each scale-step by performing a soft indexing scale transformation on the start time of each scale-step; and calculating a matching degree between a soft index value sequence of the transformed played music score and a soft index value sequence of the standard music score.

In some embodiments, the calculating the matching degree between the soft index value sequence of the transformed played music score and the soft index value sequence of the standard music score comprises obtaining a series of scale-step matching lines in the preset time period by connecting scale-steps of the played music score with corresponding scale-steps of the standard music score in the transformed two-dimensional coordinate system; if the number of scale step matching lines which satisfy a matching condition is greater than a preset threshold, determining that the matching between the played music score and the standard music score is successful, and outputting the music score matching degree; If the number of scale step matching lines which satisfy a matching condition is not greater than a preset threshold, determining that the matching between the played music score and the standard music score is unsuccessful, and obtaining and comparing another standard music score with the played music score, wherein the matching condition is that an absolute value of a difference between offset values of adjacent scale-step matching lines is smaller than a first preset value, and the offset value of the scale-step matching line is a difference between the soft index values of a pair of scale-steps corresponding to the scale-step matching line.

In some embodiments, the obtaining the series of scale-step matching lines in the preset time period by connecting scale-steps of the played music score with corresponding scale-steps of the standard music score in the transformed two-dimensional coordinate system comprises comparing the scale step sequence of the played music score with the scale-step sequence of the standard music score, and obtaining a scale-step sequence matching degree between the scale-step sequence of the played music score and the standard music score; if the scale-step sequence matching degree reaches a second preset value, determining that the matching between the played music score and the standard music score is successful; ignoring unmatched scale-steps; and obtaining scale-step matching lines by connecting scale-steps of the played music score to corresponding scale-steps of the standard music score; and if the scale-step sequence matching degree does not reach a second preset value, determining that the matching between the played music score and the standard music score is unsuccessful; and obtaining and comparing another standard music score with the played music score.

In some embodiments, the method may further include prompting selections for continuing to play the music score from a current progress or from a beginning of the standard music score after the standard music score is extracted; and displaying a corresponding portion of the standard music score according to the selection.

According to a second aspect of the present disclosure, a music score matching system is provided, the system includes an information acquisition module, a storage device, and a processor. The information acquisition module may be configured to acquire performance information in a preset time period, wherein the performance information is related to a musical device. The storage device is configured to store a standard music score. The processor is separately connected to the information acquisition module and the storage, and is configured to analyze the performance information and obtaining a played music score in the preset time period, wherein the played music score contains the performance information; compare the played music score with one or more standard music scores; and identify a standard music score from the one or more standard music score based on the comparison of the played music score with the one or more standard music scores, wherein a matching degree between the played music score and the identified standard music score reaches a preset value.

According to a third aspect of the present disclosure, a smart musical instrument is provided, which including a music score matching system as described above.

According to a fourth aspect of the present disclosure, a computer readable storage medium storing a computer program is provided, when executed by at least one of a processor, cause the processor to perform the music score matching method as described above.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These exemplary embodiments are non-limiting exemplary embodiments, in which like reference numerals represent similar structures throughout the several views of the drawings, and wherein.

DETAILED DESCRIPTION

Figure 1:
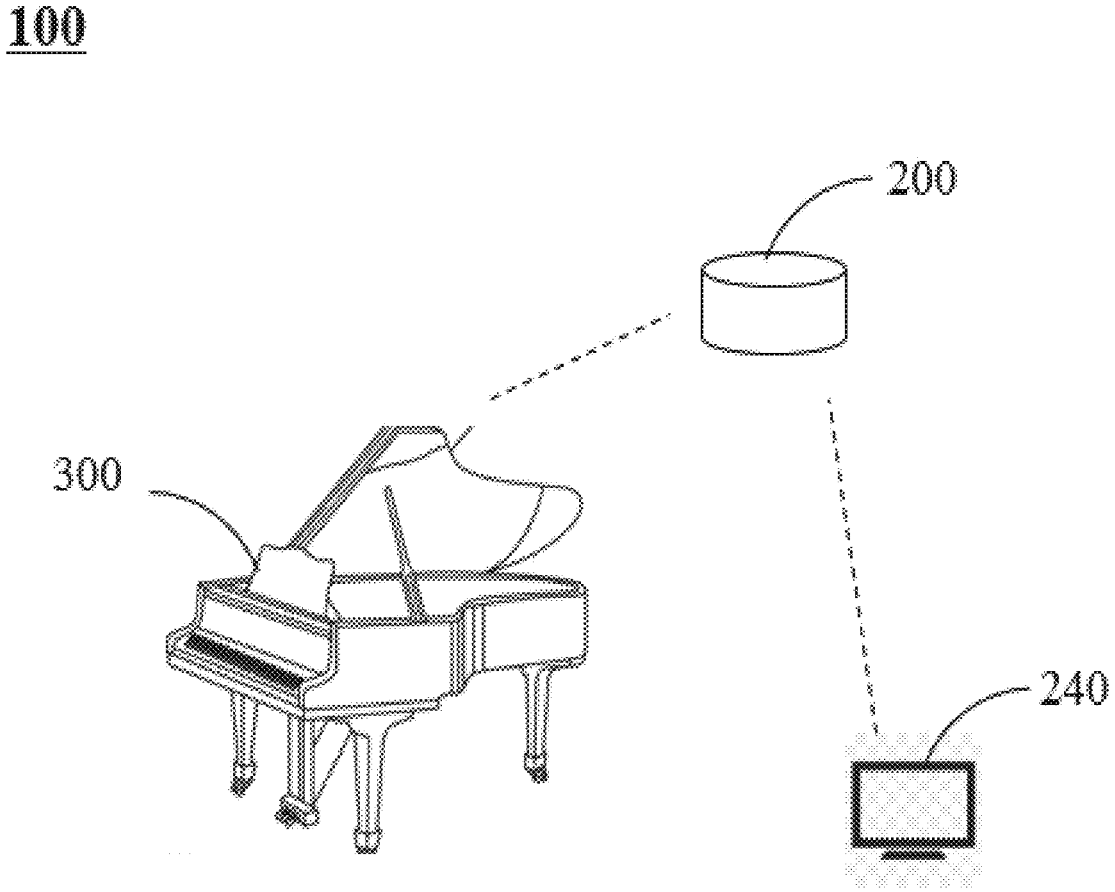
FIG. 1 is a schematic diagram illustrating an exemplary application scenario of a music score matching system according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure and those having ordinary skills in the art, without further creative efforts, may apply the present disclosure to other similar scenarios according to these drawings. Unless stated otherwise or obvious from the context, the same reference numeral in the drawings refers to the same structure or operation.

As used in the disclosure and the appended claims, the singular forms "a", "an", and "the" may be intended to include the plural forms as well, unless the context clearly indicates otherwise. It will be further understood that the terms "comprises," "comprising," "includes," and/or "including" when used in the disclosure, specify the presence of stated steps and elements, but do not preclude the presence or addition of one or more other steps and elements.

Although the present disclosure makes various references to certain modules or units in the system according to some embodiments of the present disclosure, any number of different modules or units may be used and executed on a client terminal and/or a server. The modules are illustrative only, and different aspects of the system and method may be performed in different modules.

The flowcharts used in the present disclosure illustrate operations that systems implement according to some embodiments of the present disclosure. It is to be expressly understood, the operations of the flowcharts may be implemented not in order. Conversely, the operations may be implemented in inverted order, or simultaneously. Moreover, one or more other operations may be added to the flowcharts. One or more operations may be removed from the flowcharts.

FIG. 1 is a schematic diagram illustrating an exemplary application scenario of a music score matching system according to some embodiments of the present disclosure. The application scenario 100 may include a music score matching system 200 and a musical device 300. The music score matching system 200 and the musical device 300 may be described in detail in combination with FIG. 2.

Figure 2:
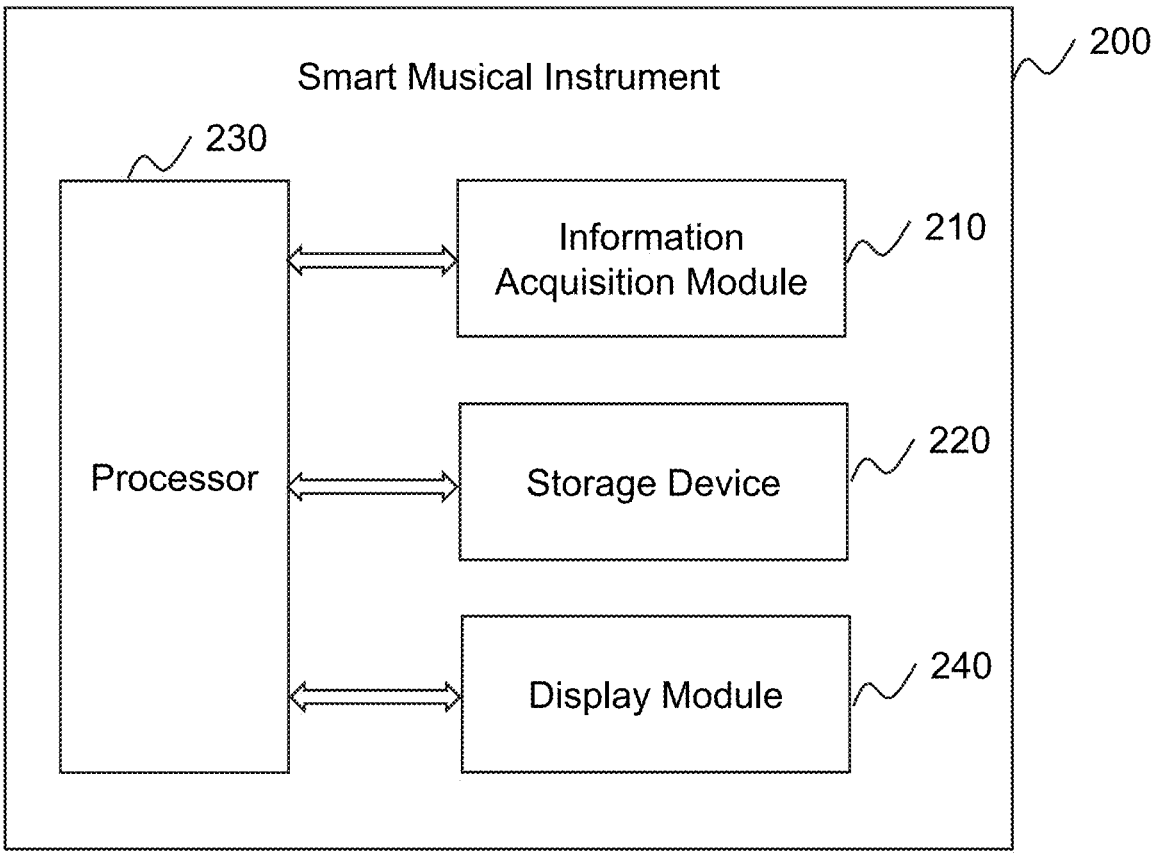
FIG. 2 is a block diagram illustrating an exemplary music score matching system according to some embodiments of the present disclosure.

FIG. 2 is a block diagram illustrating an exemplary music score matching system according to some embodiments of the present disclosure. As shown in FIG. 2, the music score matching system 200 may include an information acquisition module 210, a storage device 220, and a processor 230. The music score matching system 200 may be configure to match a standard music score for a currently played music score. The currently played music score may also be referred as played music score, which is played a user (e.g., a player of a musical instrument). The information acquisition module 210 may be configured to acquire performance information in a preset time period.

In some embodiments, the performance information may be non-audio information. For example, the performance information may include playing sequences, playing durations, playing forces, or playing speeds of keys or strings when the user plays a musical device.

The information acquisition module 210 may include at least one of a playing sequence acquisition unit, a playing duration acquisition unit, a playing force acquisition unit, or a playing speed acquisition unit.

In some embodiments, a pressure sensor may be used in the playing force acquisition unit. The pressure sensor may be connected with a key or a string of the musical device. When a player presses the key or plucks the string, the pressure sensor may obtain a pressure signal, and playing force information may be obtained according to the pressure signal obtained by the pressure sensor.

In some embodiments, a duration sensor may be used in the playing duration acquisition unit. The duration sensor may be connected with the keys or strings in the musical device. When the player presses the key or plucks the string, the duration sensor acquires a playing duration signal, thereby obtaining playing duration information. Merely by ways of example, the duration sensor may be implemented by a combination of a pressure sensor and a timer. The pressure sensor may be connected with a key or a string in the musical device. When the player presses the key or plucks the string, the pressure sensor may acquire a pressure signal and the timer may start counting the time of duration of the pressure signal, thereby obtaining the playing duration information.

In some embodiments, a speed sensor may be used in the playing speed acquisition unit. The speed sensor may be connected with a key or a string in the musical device. When the player presses the key or plucks the string, the speed sensor may obtain the speed signal of the key or the string, and playing speed information may obtained according to the speed signal obtained by the speed sensor.

In some embodiments, a sequential sensor may be used in the playing sequence acquisition unit. Playing sequence information may also be obtained by a pressure sensor or a speed sensor. For example, each key or string in a musical device may be connected with a pressure sensor, and the playing sequence information may be obtained according to a sequence of pressure signals generated by the pressure sensors connected with the keys or the strings.

The information acquisition module 210 may have a separated structure (for example, the playing sequence acquisition unit, the playing duration acquisition unit, the playing force acquisition unit, and the playing speed acquisition unit are designed as separate components or circuits relative to each other), or an integrated structure (for example, the playing sequence acquisition unit, the playing duration acquisition unit, the playing force acquisition unit, and the playing speed acquisition unit are integrated as a component or circuit).

The storage device 220 may refer to a general purpose device capable of storing data. The storage device 220 may mainly be used to store standard music scores.

In some embodiments, the standard music scores may be pre-stored in the storage device 220 offline. In other embodiments, the standard music scores may also be obtained in real time from Internet through a network, and stored in the storage device 220 if needed.

The processor 230 may be communicatively connected with the information acquisition module 210 and the storage device 220, respectively, and may be configured to identify the performance information in the preset time period, obtain a played music score containing the performance information in the preset time period, compare the played music score with multiple pre-stored standard music scores, and extract one of the multiple pre-stored standard music score. A matching degree between the played music score and the extracted standard music score reaches a preset value.

The processor 230 may execute computer instructions (program code) and perform various functions described in the present disclosure. The computer instructions may include routines, programs, objects, components, data structures, procedures, modules, and functions (the functions refer to particular functions described herein). For example, the processor 230 may process performance information obtained in a preset time period of the application scenario 100. As another example, the processor 230 may obtain a played music score containing performance information in the preset time period. As a further example, the processor 230 may compare the played music score with pre-stored standard music scores, and extract a matched standard music score. A matching degree between the played music score and the extracted standard music score reaches a preset value.

In some embodiments, the processor 230 may include a microcontroller, a microprocessor, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), a programmable logic device (PLD), or any circuit or processor capable of executing one or more functions, or the like, or any combination thereof. For illustrative purposes, the music score matching system 200 in the above embodiment includes only one processor, but it should be noted that the music score matching system 200 in the present disclosure may also include a plurality of processors.

In some embodiments, the music score matching system 200 may further include a display module 240. The display module 240 may be coupled to the processor 230, and mainly used to implement content displaying functions. For example, the display module 240 may be configured to display a current music score segment and the remaining music score in a standard music score corresponding to the currently played music score, and prompt a performance progress on the current music score segment in real time. As used herein, the music score segment refers to a segment or a portion of the music segment. The performance progress may be represented in forms of different colors on the current music score segment so as to distinguish current music score segment from the entire music score. As another example, the display module 240 may turn, under control of the processor 230, from a current page of the standard music score into a next page automatically when the performance progress reaches the end of the current page. As a further example, the display module 240 may prompt selections for continuing to play the music score from the current progress or from the beginning of the standard music score after the processor 230 extracts the standard music score, and display a corresponding portion of the standard music score according to the selection.

In some embodiments, the display module 240 may be a screen. For example, a LED screen, a LCD screen, etc.

In some embodiments, the music score matching system 200 may have a separated structure (e.g., the information acquisition module 210, the storage device 220, the processor 230, and the display module 240 are respectively designed as separate components), and have an integrated structure (e.g., the information acquisition module 210, the storage device 220, the processor 230 and the display module 240 may be integrated into one component).

The musical device 300 may be any musical device (musical instrument) that can be connected to the music score matching system 200.

In some embodiments, the musical device 300 may be an electronic musical device. For example, the electronic musical device may be a musical instrument or an electronic playing device having a MIDI output port. In some embodiments, the electronic musical device may include but is not limited to a digital piano, a digital organ (a digital pipe organ), a digital guitar, or the like.

In some embodiments, the musical device 300 may also be a non-electronic musical device. For example, a traditional mechanical piano, a traditional organ, or a traditional guitar, or the like.

In some embodiments, the musical device 300 may also be a combination of an electronic musical device and a non-electronic musical device. For example, when two or more musical devices are played together, one of the two or more musical devices may be an electronic musical device, and other musical devices may be non-electronic musical devices.

In some embodiments, the musical device 300 may be connected to the music score matching system 200 by means of a wired connection. For example, probes of various sensors of the information acquisition module 210 of the music score matching system 200 are connected to keys or strings of a musical device, and the probes may be connected to the sensors through communication wires. In some embodiments, the information acquisition module 210 of the music score matching system 200 may be installed on a musical device, and the information acquisition module 210 may be connected to the processor 230 through a communication wire. In some embodiments, the musical device 300 may be connected to the information acquisition module 210 directly through a communication wire, and the information acquisition module 210 may be connected to the processor 230 through a communication wire.

In some embodiments, the musical device 300 may be connected to the music score matching system 200 by means of a wireless connection. For example, the information acquisition module 210 of the music score matching system 200 may be installed on the musical device, and the information acquisition module 210 may be connected to the processor 230 through a wireless communication module (e.g., a wireless fidelity access, a base station, a Bluetooth access, a WiFi, etc.).

In some embodiments, the music score matching system 200 and the musical device 300 may be separate components that are in a wired or a wireless connection.

In some embodiments, the music score matching system 200 may be integrated on the musical device 300, such that the musical device 300 is turned into an smart musical instrument. For example, the music score matching system 200 may be integrated on a piano so as to form a smart piano that can match a standard music score to a music sore being played. As another example, the music score matching system 200 may be integrated on a guitar to form a smart guitar that can match a standard music score to a music score being played.

Figure 3:
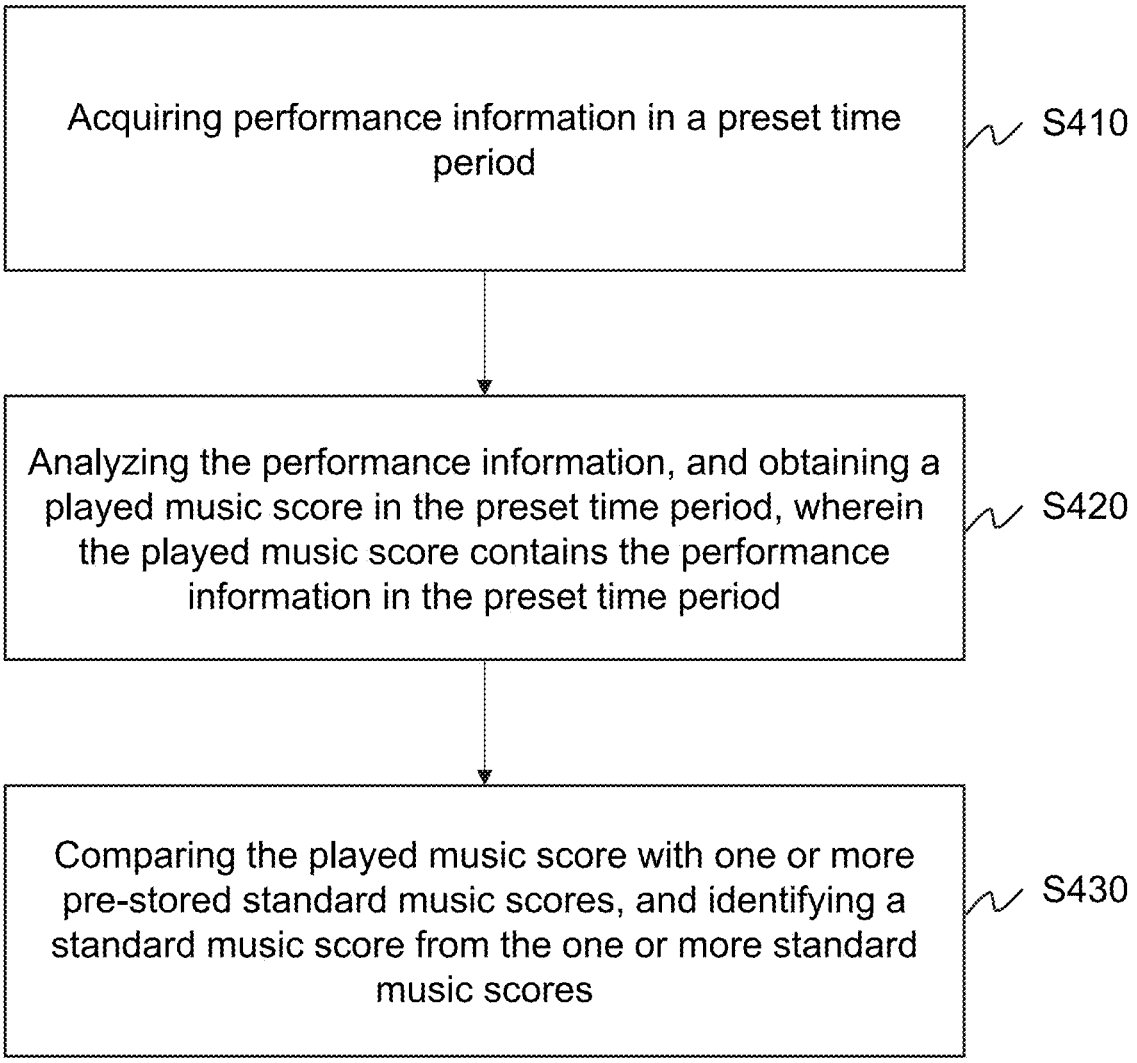
FIG. 3 is a schematic flowchart illustrating an exemplary process for matching a standard music score for a currently played music score according to some embodiments of the present disclosure.

FIG. 3 is a schematic flowchart illustrating an exemplary process for matching a standard music score for a currently played music score according to some embodiments of the present disclosure. The music score matching method 400 may be executed by the music score matching system 200 or a smart instrument. As shown in FIG. 3, the music score matching method 400 may include steps S410 through S430.

In S410, performance information of a musical device in a preset time period may be acquired.

In some embodiments, the information acquisition module 210 may acquire non-audio information when a user plays the musical device in the preset time period. Merely by ways of example, the non-audio information may be at least one type of performance information, such as playing sequences, playing durations, playing forces, or playing speeds of keys or strings when the user plays the musical device within the preset time period.

The preset time period may be preset by a user, according to actual requirements, which is not limited. For example, the preset time period may be 1 second, 3 seconds, 5 seconds, 10 seconds, 15 seconds, 30-50 seconds, 1 minute, 3 minutes, 5 minutes, 10 minutes, etc.

Merely for illustration purposes, the information acquisition module 210 may acquire the playing sequences and/or the playing durations of the keys or strings when the user plays the musical device within a time period of 10 seconds so as to identify a played music score including performance information such as playing sequences and/or playing durations.

In 420, performance information in the preset time period may be analyzed, and a played music score containing the performance information in the preset time period may be acquired.

In some embodiments, the processor 230 may analyze the performance information acquired by the information acquisition module 210 during the preset time period, and acquire a played music score (i.e., music score played in the preset time period) containing the performance information in the preset time period. The played music score may include scale-steps, scale-step sequences, scale-step durations, scale-step playing forces, or scale-step playing speeds corresponding to the played musical device. For example, if the information acquisition module 210 acquires playing sequences and playing durations of keys or strings when the user plays the musical device in the preset time period, the played music score may include scale-steps, scale-step sequences and scale-step durations corresponding to the played musical device. Merely for illustration purposes, a pressure sensor may be used in the force acquisition unit. The pressure sensor may be connected with a key or a string of the musical device. When a player presses the key or plucks the string, the pressure sensor may obtain a pressure signal, and playing force information may be obtained based on the pressure signal obtained by the pressure sensor. A duration sensor may be used in the playing duration acquisition unit. The duration sensor may be connected with a key or a string in the musical device. When the player presses the key or plucks the string, the duration sensor may acquire a playing duration signal, thereby obtaining playing duration information based on the playing duration signal. In some embodiments, the duration sensor may be implemented by a combination of a pressure sensor and a timer. The pressure sensor may be connected with a key or a string in the musical device. When the player presses the key or plucks the string, the pressure sensor may acquire a pressure signal, and the timer may start counting a playing duration of the pressure signal, thereby obtaining the playing duration information. A speed sensor may be used in the playing speed acquisition unit. The speed sensor may be connected with a key or a string in the musical device. When the player presses the key or plucks the string, the speed sensor may obtain a speed signal of the key or the string, and playing speed information may be obtained based on the speed signal obtained by the speed sensor. A sequence sensor may be used in the playing sequence acquisition unit. Playing sequence information may be obtained by the pressure sensor or the speed sensor. For example, each key or each string in a musical device may be connected with a pressure sensor, and the playing sequence information may be obtained based on a sequence of pressure signals generated by pressure sensors connected with keys or strings.

Each scale-step may be an independent sound in a music system. The music system refers to a sum of sounds having a fixed tone used in music. For example, a sound produced by each of 88 keys of a piano may correspond to a scale-step.

In 430, the played music score may be compared with multiple standard music scores pre-stored in the storage device 220, and one of the multiple standard music scores may be identified. A matching degree between the played music score and the identified standard music score may reach a preset value.

In some embodiments, the processor 230 may compare the played music score, which may be obtained according to the performance information acquired by the information acquisition module 210 in the preset time period, with standard music scores stored in the storage device 220, and identify the standard music score. A matching degree between the played music score and the extracted standard music score may reach a preset value. In this way, the standard music score of the music being played may be determined and displayed to the user.

Figure 4:
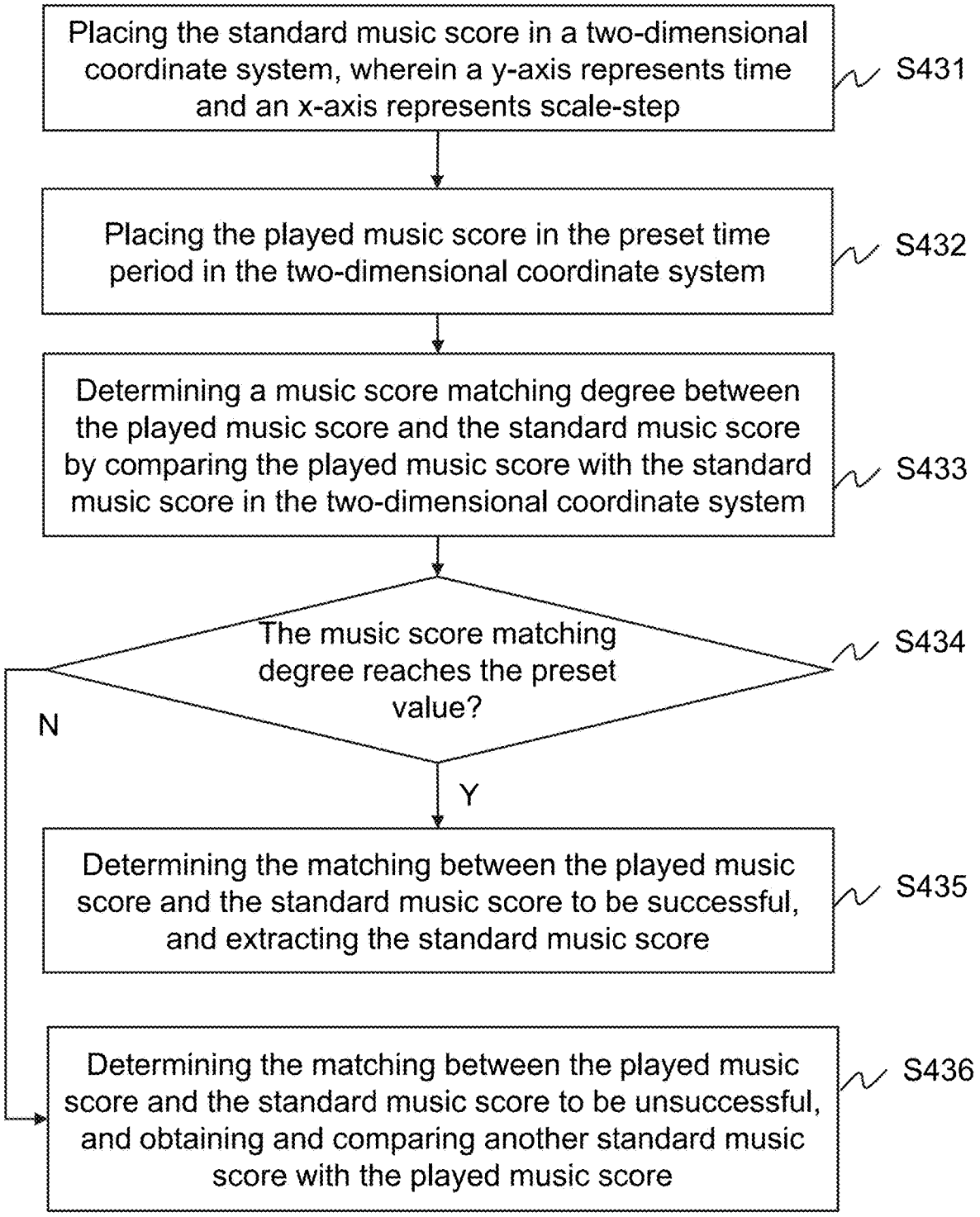
FIG. 4 is a schematic flowchart illustrating an exemplary process for extracting a standard music score according to some embodiments of the present disclosure.

FIG. 4 is a schematic flowchart illustrating an exemplary process for extracting a standard music score according to some embodiments of the present disclosure.

In some embodiments, as shown in FIG. 4, the process for extracting the standard music score may include steps S431 through S436.

In S431, standard music scores may be identified using a two-dimensional coordinate system. The y-axis of the two-dimensional coordinate system represents time, and the x-axis of the two-dimensional coordinate system represents scale-step.

In some embodiments, the processor 230 may obtain a plurality of standard music scores from the storage device 220, and identify the plurality of standard music scores using a two-dimensional coordinate system. For example, the processor 230 may place a standard music score on the left side of the y-axis and a played music score on the right side of the y-axis. The y-axis of the two-dimensional coordinate system represents time, and the x-axis of the two-dimensional coordinate system represents scale-step.

In S432, the played music score in the preset time period may be identified using the two-dimensional coordinate system.

In some embodiments, the processor 230 may identify the played music score in the two-dimensional coordinate system. The played music score may be obtained according to the performance information acquired by the information acquisition module 210 during the preset time period.

In S433, the played music score obtained in the preset time period may be compared with at least one of the plurality of standard music scores in the two-dimensional coordinate system, and at least one music score matching degree between the played music score obtained in the preset time period and the at least one standard music score may be obtained.

In some embodiments, the processor 230 may compare the played music score obtained in the preset time period with at least one of the plurality of standard music scores in the two-dimensional coordinate system so as to obtain at least one music score matching degree between the played music score and the at least one standard music score. For example, the processor 230 may compare the played music score obtained in the preset time period with one, two, three, four, five or more than five standard music scores in the two-dimensional coordinate system so as to improve efficiency. If the music score matching degree between the played music score and more than one standard music score reaches the preset value, the processor 230 may extract a standard music score according to the value of the music score matching degree (i.e., a standard music score with a highest music score matching degree may be extracted preferentially).

Figure 5:
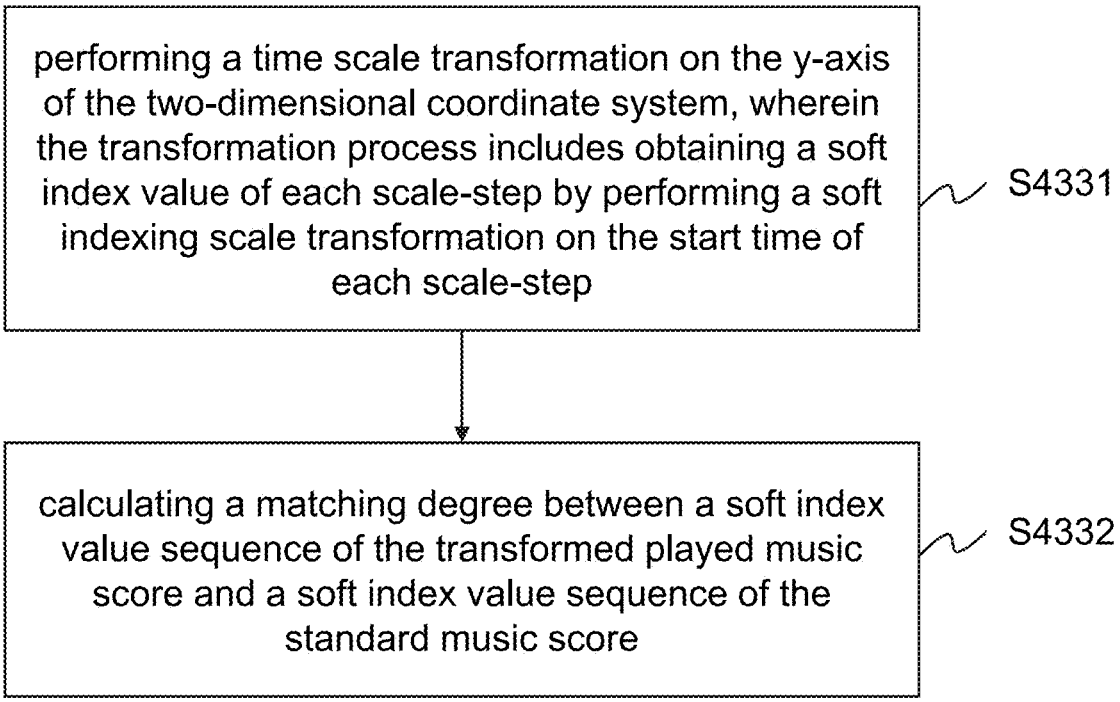
FIG. 5 is a schematic flowchart illustrating an exemplary process for calculating a matching degree between a soft index value sequence of a transformed played music score and a soft index value sequence of a standard music score according to some embodiments of the present disclosure.

FIG. 5 is a schematic flowchart illustrating an exemplary process for calculating a matching degree between a soft index value sequence of a transformed played music score and a soft index value sequence of a standard music score according to some embodiments of the present disclosure.

In some embodiments, the process that the processor 230 compares the played music score obtained in the preset time period with at least one standard music score in the two-dimensional coordinate system may be shown in FIG. 5, which may include steps S4331 through S332.

In S4331, a time scale transformation may be performed on the y-axis of the two-dimensional coordinate system, such that a transformed two-dimensional coordinate system may be obtained. The transformation process may include obtaining a soft index value of each scale-step by performing a soft indexing scale transformation on a start time of each scale-step.

In some embodiments, the processor 230 may determine a soft index value of each scale-step of the played music score and the standard music score by perform soft indexing scale transformation on a start time of each scale-step of the played music score and the standard music score, respectively, such that soft index value sequences of the played music score and the standard music score may be obtained.

In some embodiments, the soft index value of each scale-step may be obtained by performing the soft indexing scale transformation on the start time of each scale-step using Equation (1):

$$SoftIndex(n) = \sum_{i=1}^{n} f\left(\frac{1}{k} \cdot \text{interval}(i)\right), \quad (1)$$

where n denotes the n-th scale-step, interval(i) denotes a difference between the start time of i-th scale-step and the start time of i-1-th scale-step, i=1, . . . , n. interval(1) may be set to 0. k denotes a reference duration of a soft index. The reference duration of the soft index may be predetermined (the value of the reference duration of the soft index may be predetermined according to actual requirements, for example, k= . . . ). The f(x) function in Equation (1) has the following features: a function curve of the f(x) function tangents to a straight line y=x if x=0, and the function curve of the f(x) function approaches another straight line y=1 if x→∞. Merely by ways of example, f(x) function that satisfies the above features may include but not limited to $$f(x) = \tan x = \frac{1 - e^{-2x}}{1 + e^{-2x}},$$

$$f(x) = \frac{x}{x+1},$$

$$f(x) = \frac{(x+1)^m - 1}{(x+1)^m},$$

where m may be a constant. For example, m≥1.

It should be noted that the f(x) function may be adjusted according to actual requirements flexibly, which is not limited in the present disclosure.

In S4332, a matching degree between the soft index value sequence of the transformed played music score and the soft index value sequence of the standard music score may be calculated.

Figure 6:
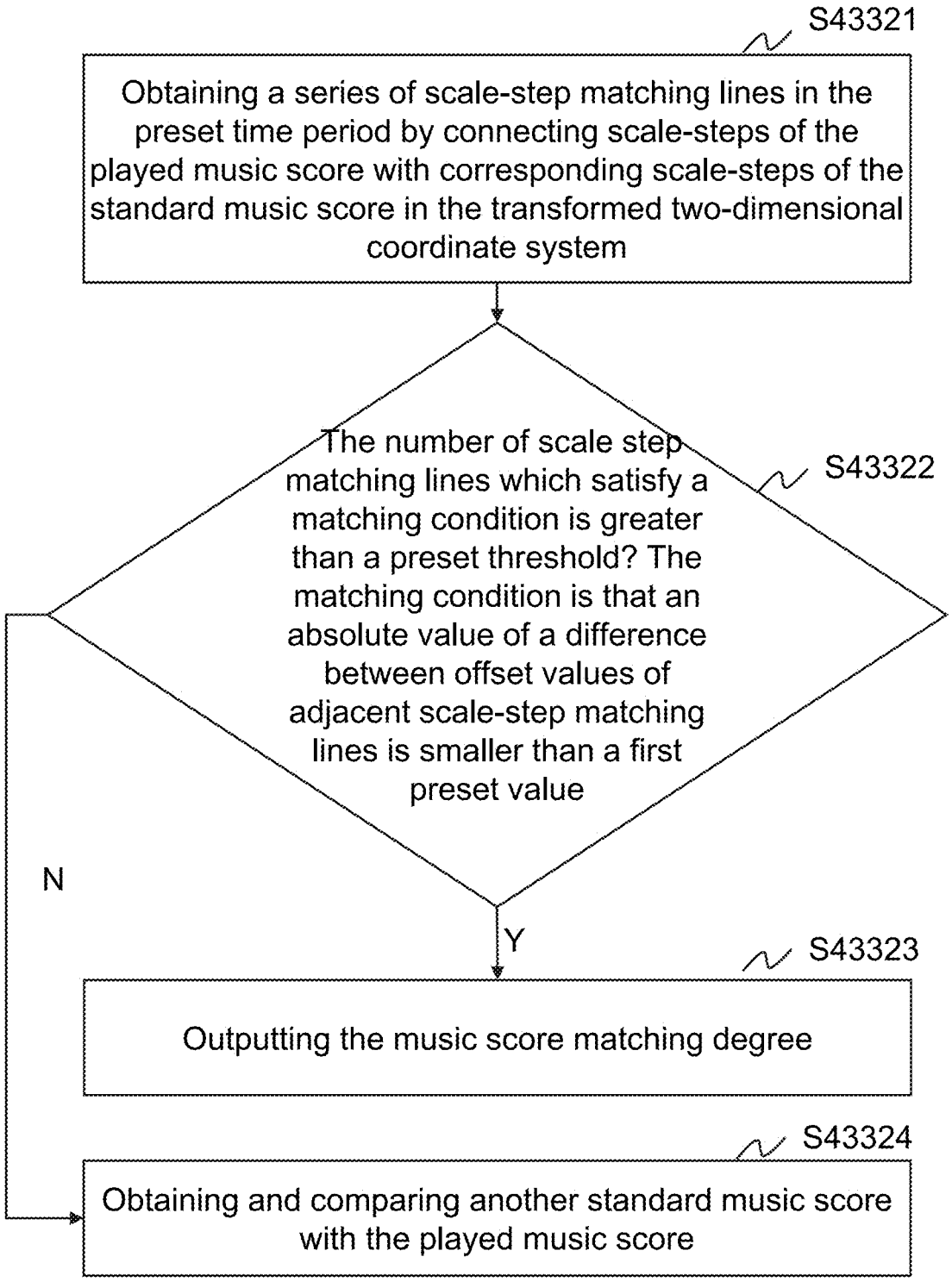
FIG. 6 is a schematic flowchart illustrating an exemplary process for obtaining a series of scale-step matching lines in the preset time period according to some embodiments of the present disclosure.

FIG. 6 is a schematic flowchart illustrating an exemplary process for obtaining a series of scale-step matching lines in the preset time period according to some embodiments of the present disclosure.

In some embodiments, the process that the processor 230 calculates a matching degree between the soft index value sequence of the transformed played music score and the soft index value sequence of the standard music score may be shown in FIG. 6, which may include steps S43321 through S43324.

In S43321, a series of scale-step matching lines in the preset time period may be obtained by connecting scale-steps of the played music score with the corresponding scale-steps of the standard music score in the transformed two-dimensional coordinate system.

Figure 8:
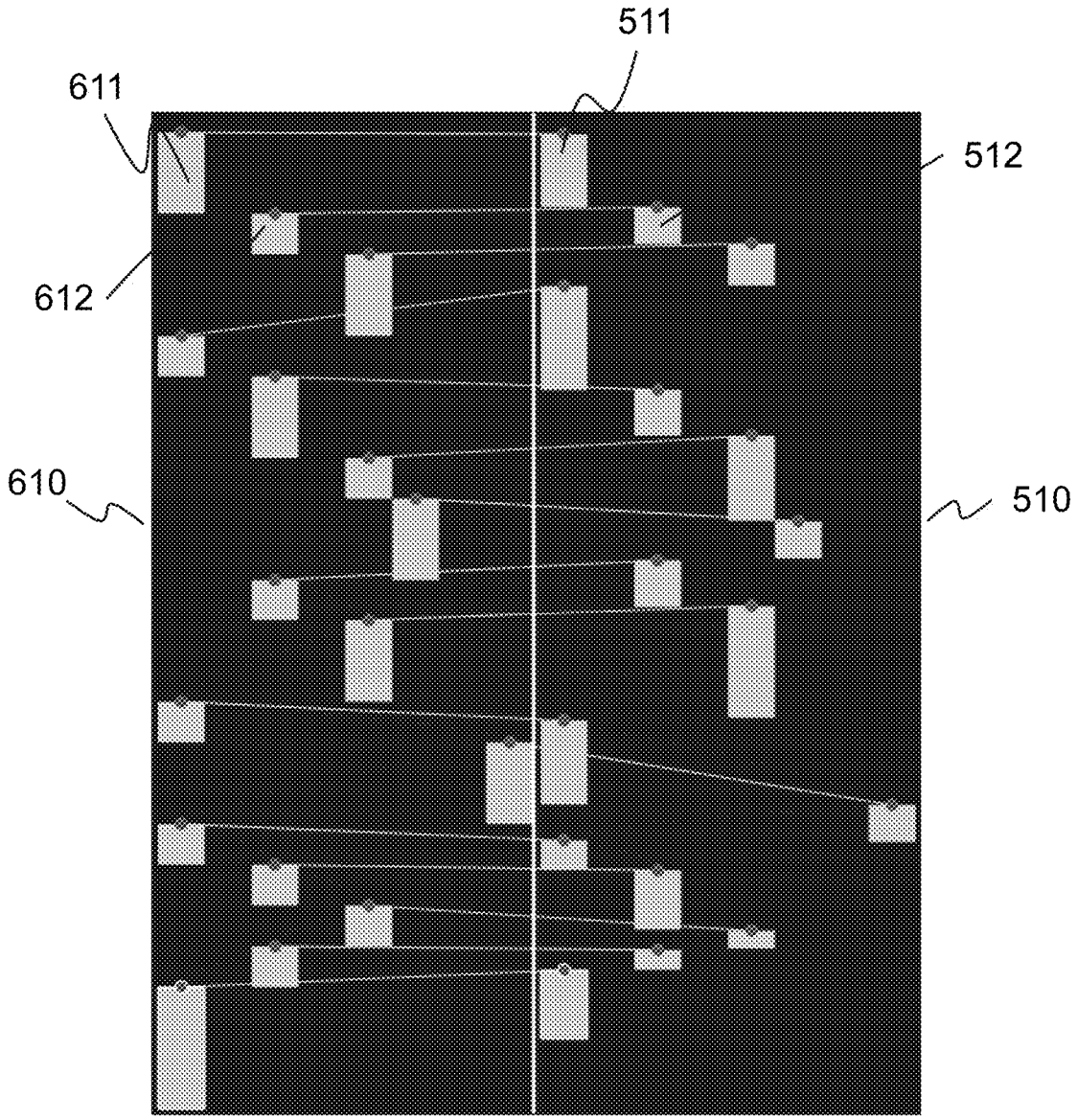
FIG. 8 is an exemplary view of music score matching before a time scale transformation is performed on the y-axis of the two-dimensional coordinal system according to some embodiments of the present disclosure.

For example, as shown in FIG. 8, the played music score 510 may be placed on the right side of the figure, and the standard music score 610 is placed on the left side of the figure. The played music score 510 may include a first scale-step 511 and a second scale-step 512, and the standard music score 610 may include a third scale-step 611 and a fourth scale-step 612. Merely by ways of example, the connecting line between the first scale step 511 and the third scale step 611 may be defined as a scale-step matching line.

Figure 7:
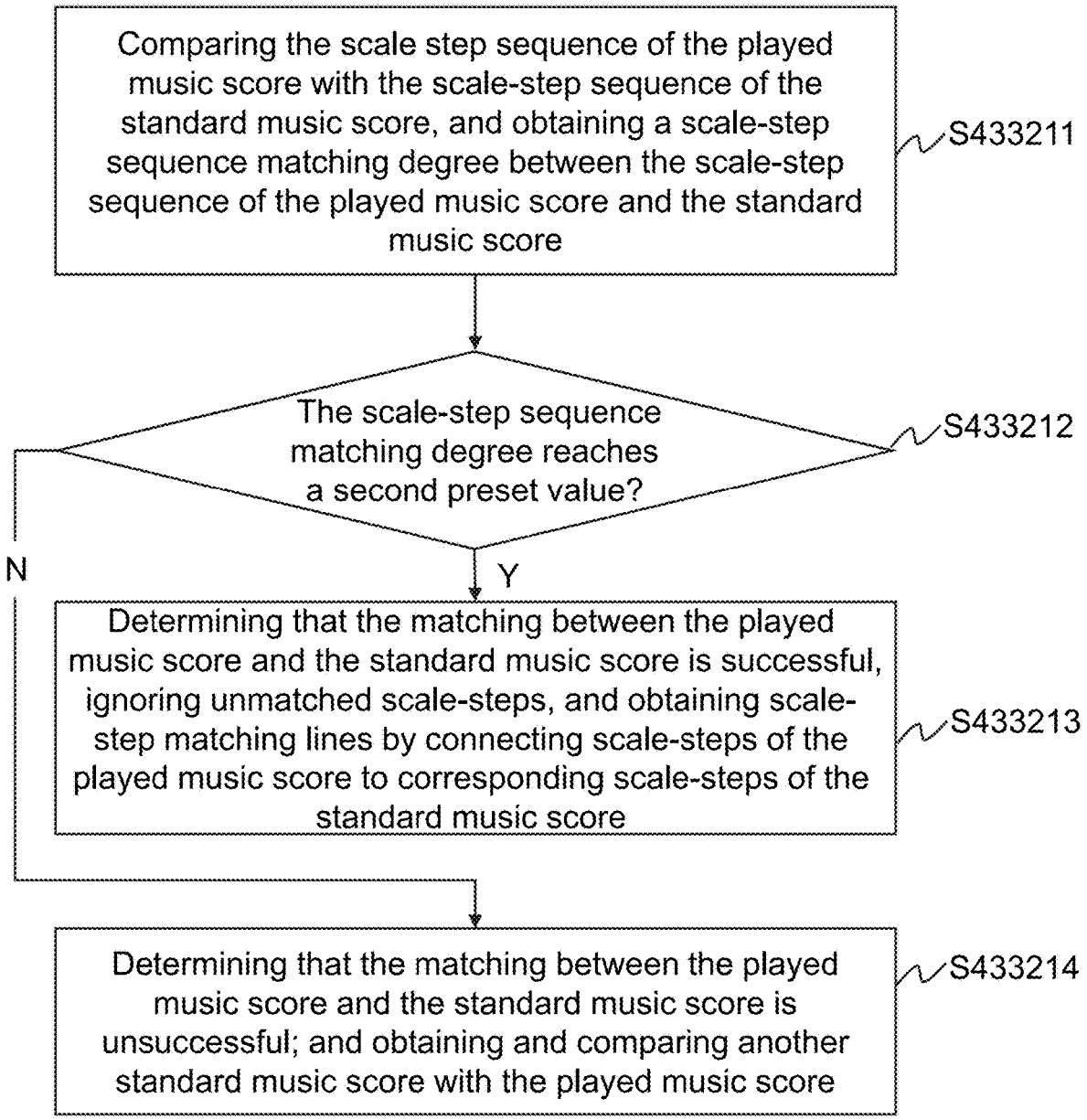
FIG. 7 is a schematic flowchart illustrating an exemplary process for obtaining a series of scale-step matching lines in the preset time period according to some embodiments of the present disclosure.

FIG. 7 is a schematic flowchart illustrating an exemplary process for obtaining a series of scale-step matching lines in the preset time period according to some embodiments of the present disclosure.

In some embodiments, the process that the processor 230 acquires the series of scale-step matching lines in the preset time period may be shown in FIG. 7, which may include steps S433211 through S433214.

In S433211, the processor 230 may compare the scale-step sequence of the played music score with the scale-step sequence of the standard music score, and obtain a scale-step sequence matching degree between the scale-step sequence of the played music score and the standard music score.

In S433212, if the scale-step sequence matching degree exceeds a second preset value (e.g., the second preset value may be 70%), the matching between the played music score and the standard music score is deemed as successful, otherwise, the matching between the played music score and the standard music score is deemed as unsuccessful.

If the matching succeeds, the process may proceed to S433213, in which unmatched scale-steps may be ignored (e.g., removed), and scale-step matching lines may be obtained by connecting scale-steps of the played music score with corresponding scale-steps of the standard music score. If a scale-step in the played music score is different from a corresponding scale-step in the standard music score, the two scale-steps may be defined as unmatched scale-steps.

In some embodiments, the unmatched scale-step may include an error scale-step, a missing scale-step, or a redundant scale-step.

If the matching fails, the process may proceed to S433214, in which another standard music score may be compared with the played music score.

For example, the process for comparing the scale-step sequence of the played music score with the scale-step sequence of the standard music score may include one or more of the following operations. The one or more operations may include aligning the first scale-step of the scale-step sequence of the played music score with the first scale-step of the scale-step sequence of the standard music score, extracting a scale-step sequence of a same length from each of the played music score and the standard music score, comparing the extracted scale-step sequence of the played music score and the extracted scale-step sequence of the standard music score. If a scale-step sequence matching degree of the two extracted scale-step sequences reaches the second preset value, the matching between the played music score and the standard music score is deemed as successful, otherwise, the matching between the played music score and the standard music score is deemed as unsuccessful. The one or more operations may further include aligning the first scale-step of the scale-step sequence of the played music score with a next scale-step of the scale-step sequence of the standard music score, extracting a scale-step sequence of a same length from each of the played music score and the standard music score, comparing the extracted scale-step sequence of the played music score and the extracted scale-step sequence of the standard music score.

In S43322, if the number of scale-step matching lines which satisfy a matching condition is greater than a preset threshold, the matching between the played music score and the standard music score is deemed as successful, otherwise, the matching between the played music score and the standard music score is deemed as unsuccessful.

If the matching succeeds, the process may proceed to S43323, in which a music score matching degree may be output (e.g., displayed on the display module 240).

In some embodiments, a scale-step of the standard music score being connected to another scale-step of the played music score through a scale-step matching line may be defined as a corresponding scale-step of the another scale-step.

In some embodiments, the music score matching degree may be defined as a percentage of the number of a first portion scale-step matching lines of which to the number of all scale-step matching lines. Absolute values of differences between offset values of the scale-step matching lines and offset values of adjacent connecting lines successfully matched may be smaller than the first preset value.

If the matching fails, the process may proceed to S43324, in which a next standard music score may be compared with the played music score.

In some embodiments, the matching condition may be that an absolute value of a difference between offset values of adjacent scale-step matching lines is smaller than the first preset value. Merely for illustration, in FIG. 8, a difference between an offset value of a scale-step matching line connecting a first scale-step 511 with a third scale step 611 and an offset value of a scale-step matching line connecting a second scale-step 512 with a fourth scale-step 612 may be an offset value of adjacent scale-step matching lines.

The offset value of the scale-step matching line may be a difference between the soft index values of a pair of scale-steps (such as the first scale-step 511 and the third scale-step 611) corresponding to the scale-step matching line (e.g., the offset value=a sample soft index value−a reference soft index value, or the offset value=the reference soft index value−the sample soft index value). Merely for illustration purposes, in FIG. 8, a difference between the soft index value of the first scale-step 511 and the soft index value of the third scale-step 611 may be the offset value of the scale-step matching line between the first scale step 511 and the third scale step 611.

The sample soft index value may be a soft index value of the standard music score, and the sample soft index value may be a soft index value of the played music score.

In some embodiments, the preset threshold and/or the first preset value may be adjusted flexibly according to actual requirements. For example, the preset threshold may be set as 5, 10, 15, etc., and the first preset value may be set as . . . . It should be noted that the scope of the present disclosure is not limited to the specific value of the preset threshold and the first preset value.

In some embodiments, the music score matching degree between the played music score and the standard music score in the preset time period may also be obtained by the following process. The process may include connecting scale-steps of the played music score with corresponding scale-steps of the standard music score in the two-dimensional coordinate system, obtaining a series of scale-step matching lines in the preset time period. A scale-step matching angle may be defined as a difference between a right angle and an angle between each of the series of scale-step matching lines and the y-axis. If scale-step matching angles of the scale-step matching lines are within a first preset range, and the number of the scale-step matching lines are greater than the preset number, the matching between the played music score and the standard music score is deemed as successful, and the music score matching degree may be output, otherwise, the matching between the played music score and the standard music score is deemed as unsuccessful. If the matching fails, a next standard music score may be obtained and compared with the played music score.

In S434, a determination may be made as to whether the music score matching degree reaches a preset value.

In some embodiments, the processor 230 may determine whether the music score matching degree reaches a preset value. The preset value may not be limited, and may be adjusted according to actual requirement instead. For example, the preset value may be 50%, 60%, 70%, 80%, 90 or the like. It should be noted that the scope of the present disclosure is not limited to the specific value of the preset value.

If the music score matching degree reaches the preset value, the matching between the played music score and the standard music score is deemed as successful, and the processor 230 may execute step S435, in which a standard music score is extracted. The matching degree between the extracted standard music score and the played music score may reach the preset value. For example, if the matching degree between the played music score and a first standard music score reaches a preset value, it may indicate that the played music score is the first standard music score, and the first standard music score may be extracted for display. When music score matching degrees between the played music score and a plurality of standard music scores reach the preset value at the same time, the processor 230 may extract a standard music score according to the music score matching degree (i.e., the standard music score with a highest music score matching degree may be extracted).

If the music score matching degree does not reach the preset value, the matching between the played music score and the standard music score may be deemed as unsuccessful, and the processor 230 may execute step S436, in which a next standard music score may be obtained and compared with the played music score.

FIG. 8 is an exemplary view of music score matching before a time scale transformation is performed on the y-axis of the two-dimensional coordinal system according to some embodiments of the present disclosure. Referring to FIG. 8, the played music score may be placed on the right side of the figure, and the standard music score may be placed on the left side. The standard music score has rhythms of different lengths. There is a great difference between rhythms of the played music score and the standard music score even though the player plays in a correct sequence.

Figure 9:
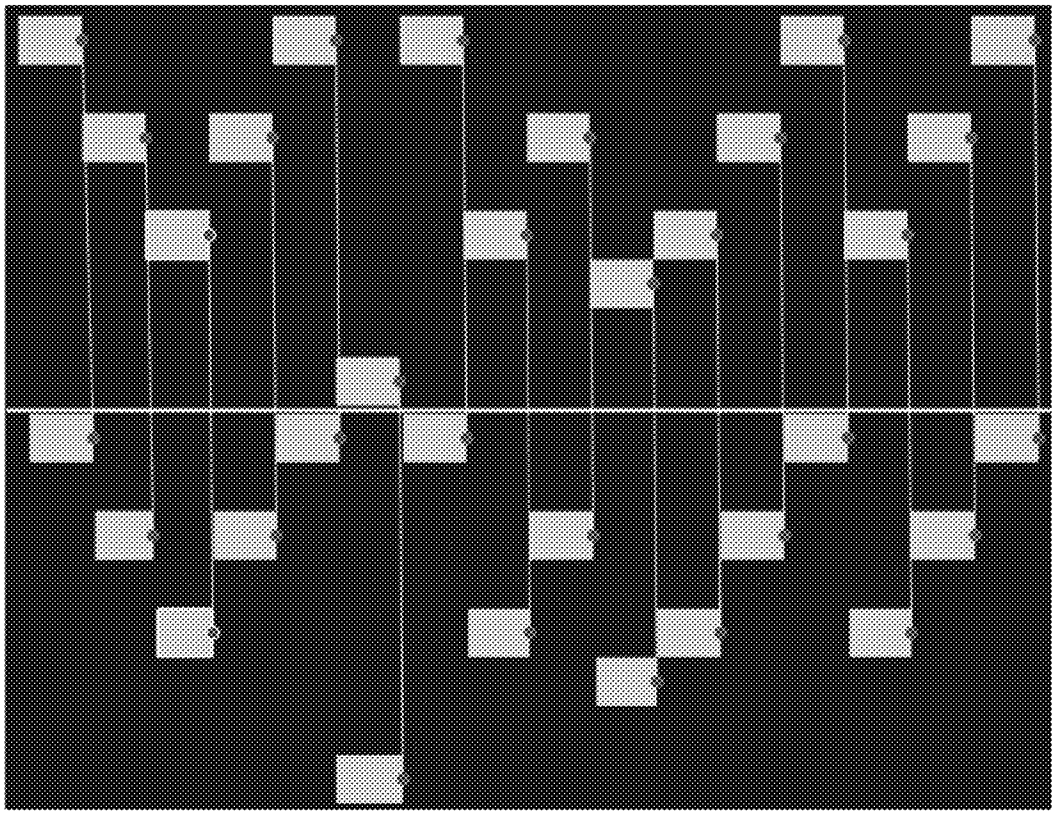
FIG. 9 is an exemplary view of music score matching after a time scale transformation is performed on the y-axis of the two-dimensional coordinal system according to some embodiments of the present disclosure.

FIG. 9 is an exemplary view of music score matching after a time scale transformation is performed on the y-axis of the two-dimensional coordinal system according to some embodiments of the present disclosure. Referring to FIG. 9, the played music score may be placed on the right side of the figure, and the standard music score may be placed on the left side. The difference between rhythms of the played music score and the standard music score may be eliminated after the time scale transformation, and the scale-steps of the standard music score on the left side may correspond to the scale-steps of the played music score right side regularly.

The music score matching method, system and smart instrument provided herein may have the following benefits. Since the music score matching method, system and smart instrument of the present disclosure acquires non-audio information such as playing sequences, playing durations, playing forces, and/or playing speeds of keys and/or strings when a user plays a musical device, thus solving problems such as high technical cost, high error rate and poor user experience in the existing music information matching methods, since voice recognition technology, which is always used to recognize scale-steps, needs a sound acquisition module and a voice recognition program, and is greatly influenced by environmental factors in the existing music information matching methods.

In addition, the method and system in present disclosure is barely affected by a playing speed difference between the player and the music score, as well as an incorrect rhythm when the player plays the musical device, which reduces the requirement of an accuracy of the performance in the music score matching process, and is beneficial to computations in the music score matching.

In some embodiments, the music score matching method 400 may further include displaying the music score segment (i.e., currently played music score segment) and subsequent music score in the standard music score corresponding to the currently played music score in real time, and prompting a performance progress on the music score segment.

In some embodiments, the processor 230 may display the music score segment and the subsequent music score in the standard music score corresponding to the currently played music score in the standard music score in real time through the display module 240 after the standard music score is extracted. A matching degree between the played music score and the extracted standard music score reaches the preset value. In addition, the performance progress may also be prompted in real time on the music score segment (for example, the performance progress may be prompted by changing the color of the music score segment or the font of the music score segment in real time).

In some embodiments, the music score matching method 400 may further include turning from a current page of the standard music score into a next page automatically when the performance progress reaches the end of the current page of the standard music score.

In some embodiments, the display module 240 may turn, under control of the processor 230, from a current page of the standard music score into a next page automatically when the performance progress reaches the end of the current page.

In some embodiments, the music score matching method 400 may also include prompting selections for continuing to play the music score from the current progress or from the beginning of the standard music score after the standard music score is extracted, and display a corresponding portion of the standard music score according to the selection.

In some embodiments, after the processor 230 extracts a standard music score, the display module 240 may prompt, under the control of the processor 230, selections for continuing to play the music score from the current progress or from the beginning of the standard music score after the standard music score is extracted, and display a corresponding portion of the standard music score according to the selection.

As described above, the music score matching method, system and smart instrument of the present disclosure may also have the following benefits. The music score matching method, system and smart instrument uses automatic page turning technology. However, existing music score following systems need a player to handle manually or realize semi-automatic page turning according to a timer, which affects performance of a player. The player needs to find the music score manually when he/she plays a piece of music, thus resulting a poor user experience.

Another aspect of the present disclosure relates to a non-transitory computer readable storage medium storing instructions. The computer readable storage medium stores a computer program that, when executed, causes one or more processors to execute the music score matching method as described above.

The computer readable storage medium may include volatile or nonvolatile, magnetic, semiconductor, magnetic tape, optical, removable, non-removable or other types of computer readable mediums or computer readable storage devices. For example, as disclosed, the computer readable storage medium may be a storage device or a memory module storing computer instructions. In some embodiments, the computer readable storage medium may be a disk or a flash drive storing computer instructions.

It should be noted that different embodiments may have different beneficial effects. In different embodiments, the beneficial effects may be any combination of one or more of the above, or any other possible beneficial effects.

Having thus described the basic concepts, it may be rather apparent to those skilled in the art that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment," "one embodiment," or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "block," "module," "engine," "unit," "component," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a software as a service (SaaS).

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the descriptions, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and describe.

We claim:

1. A method for matching performance with score, implemented on a device having a processor and a computer-readable storage medium, the method comprising:

acquiring performance information in a preset time period, wherein the performance information is related to a musical device;

analyzing the performance information and obtaining a played music score in the preset time period, wherein the played music score contains the performance information;

comparing the played music score with two or more standard music scores; and identifying a standard music score from the two or more standard music score based on the comparison of the played music score with the two or more standard music scores, wherein a matching degree between the played music score and the identified standard music score reaches a preset value.

2. The method of claim 1, further comprising:

displaying a music score segment and subsequent music score of the identified standard music score corresponding to the played music score in real time; and displaying a prompt for a performance progress on the music score segment in real time.

3. The method of claim 2, further comprising:

turning from a current page into a next page of the standard music score automatically when the performance progress reaches an end of the current page of the standard music score.

4. The method of claim 1, wherein the performance information is non-audio information.

5. The method of claim 1, wherein the performance information includes at least one type of playing sequences, playing durations, playing forces, or playing speeds of keys or strings when the user plays the musical device.

6. The method of claim 1, wherein the played music score includes at least one of a scale-step, a scale-step sequence, a scale-step duration, a scale-step playing force, or a scale-step playing speed associated with the played musical device.

7. The method of claim 1, wherein the musical device is an electronic musical device or a non-electronic musical device.

8. The method of claim 1, wherein identifying a standard music score from the two or more standard music score based on the comparison comprises:

placing a standard music score in a two-dimensional coordinate system, wherein a y-axis of the two-dimensional coordinate system represents time and an x-axis of the two-dimensional coordinate system represents time represents scale-step;

placing the played music score acquired in the preset time period in the two-dimensional coordinate system;

determining the music score matching degree between the played music score and the standard music score by comparing the played music score with the standard music score in the two-dimensional coordinate system;

determining whether the music score matching degree reaches the preset value;

in response to the determination that the music score matching degree reaches the preset value, determining the matching degree between the played music score and the standard music score to be successful, and identifying the standard music score; and in response to the determination that the music score matching degree reaches the preset value, determining the matching between the played music score and the standard music score to be unsuccessful, and obtaining and comparing another standard music score with the played music score.

9. The method of claim 8, wherein determining the music score matching degree between the played music score and the standard music score by comparing the played music score with the standard music score in the two-dimensional coordinate system comprises:

performing a time scale transformation on the y-axis of the two-dimensional coordinate system, wherein the transformation process includes obtaining a soft index value of each scale-step by performing a soft indexing scale transformation on the start time of each scale-step; and calculating a matching degree between a soft index value sequence of the transformed played music score and a soft index value sequence of the standard music score.

10. The method of claim 9, wherein the calculating the matching degree between the soft index value sequence of the transformed played music score and the soft index value sequence of the standard music score comprises:

obtaining a series of scale-step matching lines in the preset time period by connecting scale-steps of the played music score with corresponding scale-steps of the standard music score in the transformed two-dimensional coordinate system;

if the number of scale step matching lines which satisfy a matching condition is greater than a preset threshold, determining that the matching between the played music score and the standard music score is successful, and outputting the music score matching degree;

If the number of scale step matching lines which satisfy a matching condition is not greater than a preset threshold, determining that the matching between the played music score and the standard music score is unsuccessful, and obtaining and comparing another standard music score with the played music score, wherein the matching condition is that an absolute value of a difference between offset values of adjacent scale-step matching lines is smaller than a first preset value, and the offset value of the scale-step matching line is a difference between the soft index values of a pair of scale-steps corresponding to the scale-step matching line.

11. The method of claim 10, wherein obtaining the series of scale-step matching lines in the preset time period by connecting scale-steps of the played music score with corresponding scale-steps of the standard music score in the transformed two-dimensional coordinate system comprises:

comparing the scale step sequence of the played music score with the scale-step sequence of the standard music score, and obtaining a scale-step sequence matching degree between the scale-step sequence of the played music score and the standard music score;

if the scale-step sequence matching degree reaches a second preset value, determining that the matching between the played music score and the standard music score is successful;

ignoring unmatched scale-steps; and obtaining scale-step matching lines by connecting scale-steps of the played music score to corresponding scale-steps of the standard music score; and if the scale-step sequence matching degree does not reach a second preset value, determining that the matching between the played music score and the standard music score is unsuccessful; and obtaining and comparing another standard music score with the played music score.

12. The method of claim 1, further comprising:

prompting selections for continuing to play the music score from a current progress or from a beginning of the standard music score after the standard music score is extracted; and displaying a corresponding portion of the standard music score according to the selection.

13. A music score matching system, comprising:

an information acquisition module configured to acquire performance information in a preset time period, wherein the performance information is related to a musical device;

a storage device configured to store a standard music score;

a processor, separately connected to the information acquisition module and the storage, configured to:

analyze the performance information and obtaining a played music score in the preset time period, wherein the played music score contains the performance information;

compare the played music score with two or more standard music scores; and identify a standard music score from the two or more standard music score based on the comparison of the played music score with the two or more standard music scores, wherein a matching degree between the played music score and the identified standard music score reaches a preset value.

14. The music score matching system of claim 13, wherein the system further comprises:

a display module, connected to the processor, configured to:

display a music score segment and subsequent music score of the identified standard music score corresponding to the played music score in real time, display a prompt for a performance progress on the music score segment in real time;

turn from a current page into a next page of the standard music score automatically when the performance progress reaches an end of the current page of the standard music score;

prompt selections for continuing to play the music score from a current progress or from a beginning of the standard music score after the standard music score is extracted, and display a corresponding portion of the standard music score according to the selection.

15. The music score matching system of claim 13, wherein the performance information is non-audio information.

16. The music score matching system of claim 13, wherein the performance information includes at least one type of playing sequences, playing durations, playing forces, or playing speeds of keys or strings when the user plays the musical device.

17. The music score matching system of claim 13, wherein the played music score includes at least one of a scale-step, a scale-step sequence, a scale-step duration, a scale-step playing force, or a scale-step playing speed associated with the played musical device.

18. The music score matching system of claim 16, wherein the musical device is an electronic musical device or a non-electronic musical device.

19. The music score matching system of claim 13, wherein to identify a standard music score from the two or more standard music score based on the comparison, the processor is configured to:

place a standard music score in a two-dimensional coordinate system, wherein a y-axis of the two-dimensional coordinate system represents time and an x-axis of the two-dimensional coordinate system represents time represents scale-step;

place the played music score acquired in the preset time period in the two-dimensional coordinate system;

determine the music score matching degree between the played music score and the standard music score by comparing the played music score with the standard music score in the two-dimensional coordinate system;

determine whether the music score matching degree reaches the preset value;

in response to the determination that the music score matching degree reaches the preset value, determine the matching degree between the played music score and the standard music score to be successful, and identify the standard music score; and in response to the determination that the music score matching degree reaches the preset value, determine the matching between the played music score and the standard music score to be unsuccessful, and obtain and compare another standard music score with the played music score.

20. A computer readable storage medium storing computer programs that, when executed by at least one processor, cause the at least one processor to perform a method, the method comprising:

acquiring performance information in a preset time period, wherein the performance information is related to a musical device;

analyzing the performance information and obtaining a played music score in the preset time period, wherein the played music score contains the performance information;

comparing the played music score with two or more standard music scores; and identifying a standard music score from the two or more standard music score based on the comparison of the played music score with the two or more standard music scores, wherein a matching degree between the played music score and the identified standard music score reaches a preset value.

* * * * *